US005674013A

United States Patent [19]

Koike et al.

[11] Patent Number: 5,674,013

[45] Date of Patent: Oct. 7, 1997

[54] THERMAL PRINTER

[75] Inventors: Hisayuki Koike; Toru Takami, both of Nagano, Japan

[73] Assignee: Seiko Epson Corporation, Tokyo, Japan

[21] Appl. No.: 424,198

[22] Filed: Apr. 19, 1995

[30] Foreign Application Priority Data

Apr. 21, 1994 [JP] Japan ..... 6-083415

[51] Int. Cl.[6] ..... B41J 2/335

[52] U.S. Cl. ..... 400/120.16; 347/197

[58] Field of Search ..... 400/120.16, 120.17, 400/120 HE; 347/197, 198

[56] References Cited

U.S. PATENT DOCUMENTS

| | | | |
|---|---|---|---|
| 4,835,547 | 5/1989 | Okushi et al. | 346/76 PH |
| 4,855,756 | 8/1989 | Gluck et al. | 346/76 PH |
| 5,064,300 | 11/1991 | Kashiwaba | 400/120.16 |
| 5,090,827 | 2/1992 | Hirano et al. | 400/120.16 |
| 5,118,208 | 6/1992 | Kitahara et al. | 400/120.16 |
| 5,366,302 | 11/1994 | Masumura et al. | 400/120.16 |

FOREIGN PATENT DOCUMENTS

| | | |
|---|---|---|
| 94469 | 11/1983 | European Pat. Off. . |
| 2647056 | 11/1990 | France . |
| 53-39465 | 10/1980 | Japan . |
| 56-95847 | 7/1981 | Japan . |
| 58-112553 | 8/1983 | Japan . |
| 59-120154 | 8/1984 | Japan . |
| 60-180876 | 9/1985 | Japan . |
| 62-134760 | 8/1987 | Japan . |

OTHER PUBLICATIONS

Patent Abstracts of Japan, vol. 012, No. 325 (M-737), Sep. 5, 1988 & JPA-63 092465 (NEC Corp), Apr. 22, 1988.

*Primary Examiner*—David A. Wedking

*Attorney, Agent, or Firm*—Sughrue, Mion, Zinn, Macpeak & Seas, PLLC

[57] ABSTRACT

A thermal printer having a head carriage that includes: a head support member to which the thermal head is attached; a holding member for holding the head support member; and a connecting mechanism for connecting the head support member to the holding member so as to be rockable in forward and backward as well as leftward and rightward directions. The connecting mechanism includes: a shaft member fixed to the holding member; and an insertion hole for allowing the shaft member to be inserted thereinto, the insertion hole being formed in the head support member. The width of the insertion hole in the printing direction is substantially the same as the width of the shaft member, and the width of the insertion hole in a direction of the platen, the direction being orthogonal to the printing direction, is larger than the width of the shaft member as a whole but narrowed at a position in an axial direction thereof. The head support member is rotatable in the direction of the platen.

9 Claims, 12 Drawing Sheets

THERMAL PRINTER

BACKGROUND OF THE INVENTION

The invention relates to a thermal printer for printing on thermal paper using a thermal head having a heating element array formed thereon. More particularly, the invention is directed to a thermal printer having a thermal head support mechanism that can bring the thermal head into contact with the printing paper on a platen in an appropriate condition.

The basic structure of a thermal printer is well known; i.e., the thermal printer is designed to print on thermal paper forwarded on a platen using a thermal head having heating elements arranged thereon.

The thermal printer must print with the thermal head thereof in contact with the paper on the platen in an appropriate condition. For example, while the printing operation is carried out by moving the thermal head in a horizontal direction with respect to the paper on the platen, the thermal head must be held in contact with the paper in an appropriate condition during such movement. If the appropriate contact condition cannot be maintained, e.g., if the printing operation is performed with the thermal head being in one-sided contact with the paper, then the printing is not clear, thus causing such trouble as impaired printing quality.

To bring the thermal head into contact with the paper on the platen in an appropriate condition, various techniques have heretofore been proposed. That is, the thermal head is supported by a carriage so as to be rockable in four directions, frontward, backward, leftward, and rightward, so that the thermal head surface can come in contact with the paper surface in an appropriate condition. Such a mechanism is disclosed in, e.g., Unexamined Japanese Utility Model Publication (Kokai) Sho-59-120154. The mechanism therein disclosed is characterized as supporting the thermal head so as to be rockable about a single axis through an elastic member, so that the elastic deformation of the elastic member can bring the thermal head into contact with the paper on the platen in an appropriate condition.

Further, Unexamined Japanese Utility Model Publications (Kokai) Nos. Sho. 56-95847, Sho. 58-112553, and Sho. 62-134760 disclose mechanisms, each being characterized as rockably supporting the thermal head with a coil spring.

Furthermore, Examined Japanese Patent Publication No. Sho. 55-39465 discloses a mechanism that causes the carriage to support the thermal head through a gimbal mechanism, so that the thermal head is rockable about two axes that are orthogonal to each other. Still further, Unexamined Japanese Patent Publication No. Sho. 60-180876 is characterized as rockably supporting a support plate by biasing the bottom surface of the support plate with the tip of a pivot shaft, the support plate mounting the thermal head thereon.

However, these conventional mechanisms have exhibited the following problems. First, to support the thermal head rockably, the structure of the head carriage is complicated and not compact.

Second, the mechanisms utilizing the elastic member must set the coil spring constant and the like to an appropriate value. The difficulty of arranging a small coil spring in the head carriage must be overcome. Therefore, such thermal printers cannot be manufactured inexpensively nor simply. In addition, it is essential to set the elastic properties of the elastic member to appropriate values in order to bring the thermal head into contact with the paper appropriately as a result of the appropriate rock of the thermal head without causing one-sided contact.

Still further, the mechanism using the pivot shaft must implement accurate positioning of the pivot shaft to allow the thermal head to be rockable about the pivot shaft appropriately. Therefore, the setting of the pivot shaft is difficult and, thus, this mechanism is not practical.

SUMMARY OF THE INVENTION

The object of the invention resides in proposing a thermal head that can overcome these problems.

To achieve the above object, a first aspect of the invention is applied to a thermal printer characterized as rockably supporting the thermal head in the following manner, the thermal printer including: a thermal head having heating elements formed thereon; a head carriage carrying the thermal head; a first moving mechanism for moving the head carriage in a printing direction; and a printing paper forwarding mechanism; and the thermal printer being designed to print by causing the thermal head to come in contact with a printing paper forwarded on a platen by the printing paper forwarding mechanism.

That is, the head carriage of the invention includes: a head support member to which the thermal head is attached; a holding member for holding the head support member; and a connecting mechanism for connecting the head support member to the holding member so as to be rockable in forward and backward as well as leftward and rightward directions. The connecting mechanism includes: a shaft member fixed to the holding member; and an insertion hole for allowing the shaft member to be inserted thereinto, the insertion hole being formed in the head support member. The width of the insertion hole in the printing direction is substantially the same as the width of the shaft member, and the width of the insertion hole in a direction of the platen, the direction being orthogonal to the printing direction, is larger than the width of the shaft member as a whole but narrowed at a position in an axial direction of the insertion hole. The head support member is rotatable in the direction of the platen.

As a result of the thus constructed thermal head connecting mechanism, the head support member to which the thermal head is attached is not only rockable about the axis of the shaft member (in the leftward and rightward directions), but also rockable in the direction of the platen which is orthogonal to the axis (the frontward and backward directions) around the narrowed portion (the bottleneck) of the insertion hole. Therefore, the thermal head can be set in contact with the paper on the platen in an appropriate condition in either direction, i.e., in the printing directions and in the paper forwarding directions. Hence, defective printing such as blurred printing due to one-sided positioning of the thermal head or the like can be avoided. Moreover, the invention is advantageous in achieving the rock of the thermal head about the two axes orthogonal to each other with such an extremely simple construction as involving a single shaft member and an insertion hole for allowing the shaft member to be inserted thereinto. Therefore, the head carriage is reduced to a simple design compared with those conventional mechanisms involving the elastic member, the coil spring, and the like, which in turn contributes to the inexpensive manufacture of the head carriage.

To achieve the above object, a second aspect of the invention is applied to a thermal head that further includes a second moving mechanism for moving the platen and the head relative to each other so that the head comes in pressure contact with the platen at the time of printing and the head moves away from the platen at the time of forwarding the printing paper. In this thermal head, a pressure contact surface of the thermal head is arranged with respect to the shaft member with a predetermined inclination with the thermal head being in pressure contact with the platen by the second moving mechanism.

As a result of this construction, the play of the thermal head in upward and downward directions in the connecting mechanism can be regulated by an obliquely applied force during printing, which in turn suppresses the displacement of the printing position of the thermal head and thereby prevents printing quality from being impaired. In this case, it is preferred that the pressure contact surface of the thermal head and the shaft member be arranged so as to be inclined downward with the thermal head in contact with the platen. As a result of such arrangement, a downward force is applied to the thermal head. Since the thermal head is positioned below the shaft member by its own weight in the stand-by position, the thermal head is fixed at such lower position when a downward force is applied to the thermal head. Therefore, the head position is stabilized, and the printing quality is also improved.

Furthermore, the connecting mechanism has a spring member for energizing the head supporting member in an axial direction of the shaft member.

According to the above-mentioned construction, even if the play of the thermal head exists in the upward and downward directions in the connecting mechanism, the thermal head is always placed at one of an upper position and a lower position. The displacement of the printing position of the thermal head is suppressed and thereby prevents printing quality from being impaired. In this case, if the spring member is arranged to energize in same direction with the force affected by the inclination, the printing position is more stable. Furthermore, the spring member is arranged to energize the head supporting member downwardly from the upper position, the force of the spring member is coincident with the gravitation of the head supporting member. Therefore, the position of the head supporting member is more stabilized.

In addition to the aforementioned construction, the connecting mechanism has a regulating member for regulating a quantity of rock of the head support member about an axis of the shaft member, the regulating member being located either in the head support member or in the holding member.

As a result of this construction, a shortcoming that the head support member supporting the thermal head rocks about the axis of the shaft member to cause an end of the head support member to be abutted against the paper being forwarded and thereby break the paper under the condition that the thermal head is evacuated from the platen for forwarding the printing paper can be eliminated.

Here, it is preferred that the second moving mechanism be a platen moving mechanism for moving the platen with respect to the thermal head carried on the head carriage. This construction contributes to making the mechanism compact in structure. As a result, a shortcoming that not only the moving mechanism becomes large-sized but also the printer becomes large-sized in proportion thereto as in the case of moving the thermal head since such case requires as large a moving mechanism as the distance over which the thermal head travels can be eliminated.

It may be noted that many thermal printers are of such type that the printing operation is performed as the thermal head reciprocates. In this type of thermal printer, it is preferred that the platen moving mechanism be designed to evacuate the platen from the thermal head in synchronism with the head carriage having reached either one of both end positions in the rocking direction thereof.

DETAILED DESCRIPTION OF THE PREFERRED EMBODIMENT

An embodiment of the invention will now be described with reference to the drawings.

Figure 1:
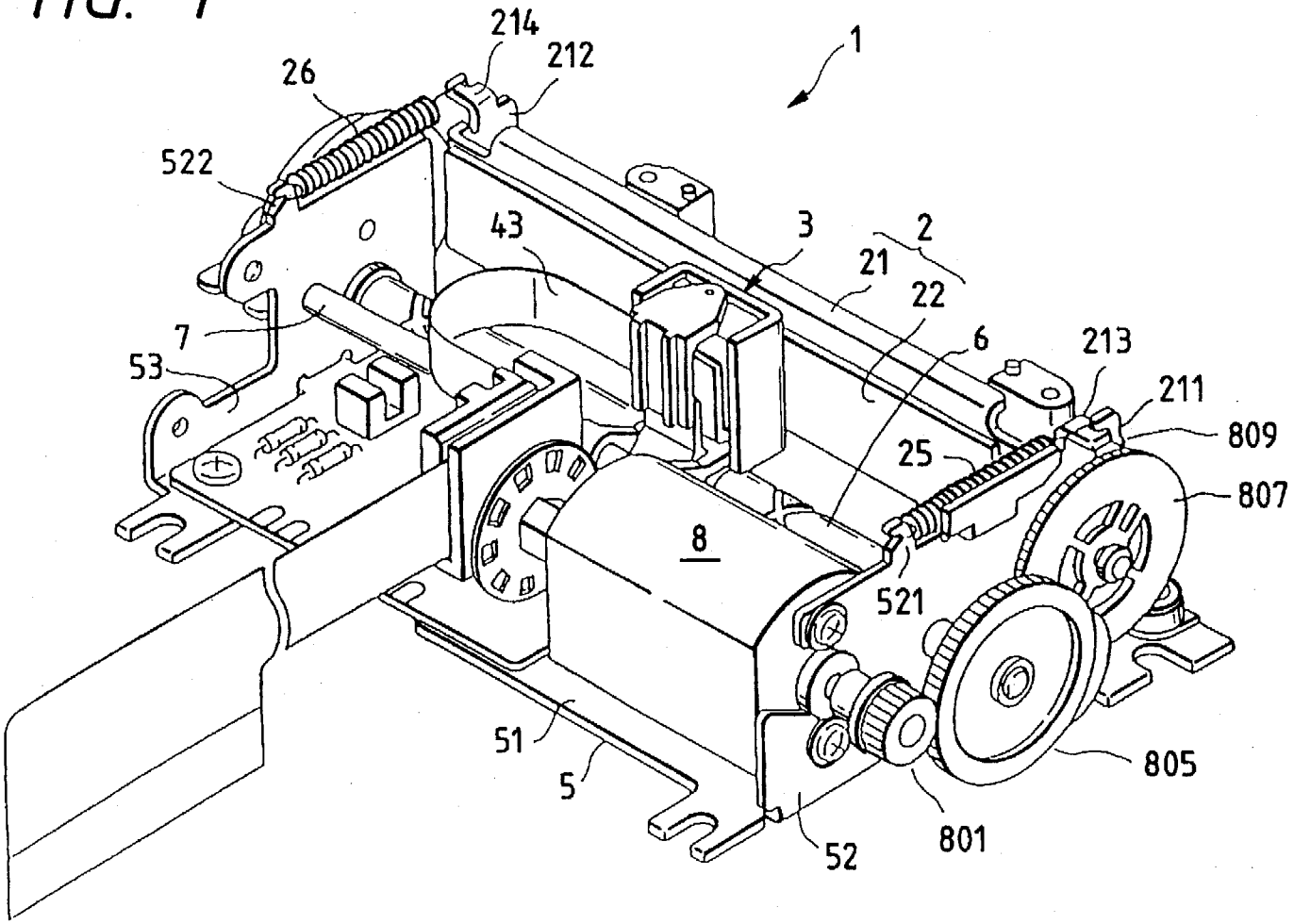
FIG. 1 is a perspective view showing a general construction of a thermal printer, which is an embodiment of the invention.
Figure 2:
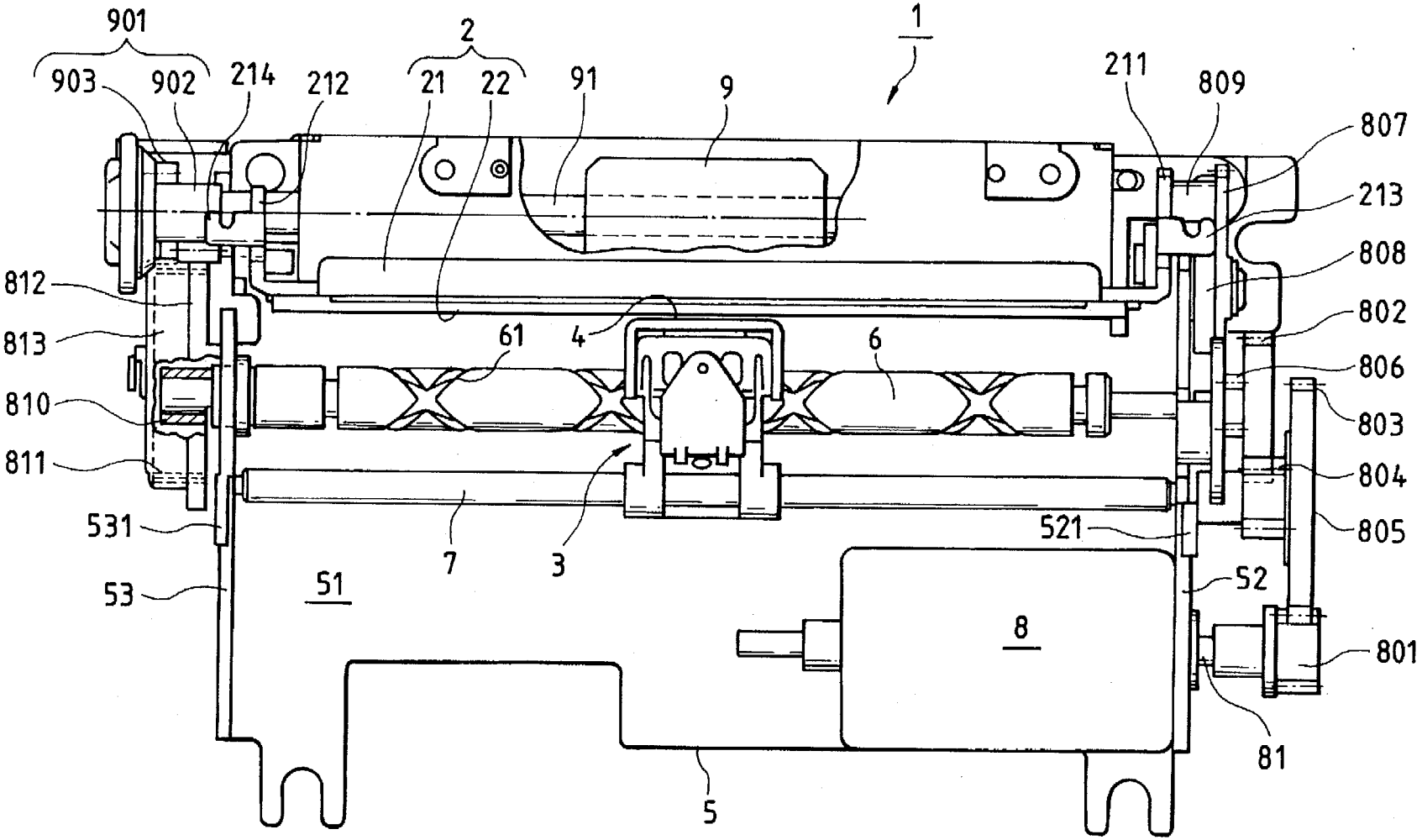
FIG. 2 is a schematic plan view of the thermal printer shown in FIG. 1.

FIGS. 1 and 2 show the general construction of a thermal printer to which the invention is applied. The thermal printer, which is the embodiment of the invention, is a serial printer that has many heating elements along the length of a thermal head thereof. This thermal printer is designed to print while the thermal head is reciprocating.

Referring to FIGS. 1 and 2, the thermal printer 1, which is the embodiment of the invention, has basically the same structure as that of ordinary thermal printers. That is, the thermal printer 1 has a platen 2, and a thermal head 4 that is carried on a head carriage 3 so as to confront the platen 2, and is designed to print by causing the thermal head 4 to come in contact with a thermal paper forwarded between the platen 2 and the thermal head 4 and causing the thermal head 4 to move in the paper width directions.

More specifically, a printer frame 5 of the thermal printer 1 has a bottom wall 51 and side walls 52, 53 that erect from the bottom wall 51. Stretched between the side walls 52, 53 is the platen 2. The platen 2 is located at a rear end position of the printer frame as viewed in the figures. In front of the platen 2 are a cylindrical cam shaft 6 and a carriage guide shaft 7 so as to be interposed between the side walls 52, 53. By the rotation of the cylindrical cam shaft 6 the head carriage 3 is guided to the guide shaft 7 so that the head carriage 3 can reciprocate in both the right and left directions (in the printing directions) in parallel with the platen 2. On the side close to the side wall 52 in front of these shafts 6, 7 is a motor 8 for driving the respective parts. The motor 8 is mounted on the bottom wall 51 so as to take such a position as to run in parallel with the shafts 6, 7. On the other hand, in the lower middle portion of the rear side of the platen 2 is a paper feed roller 9 as is apparent from FIG. 2. A roller shaft 91 of the paper feed roller 9 extends between the side walls 52, 53 on the right and the left.

(Head carriage)

Figure 3:
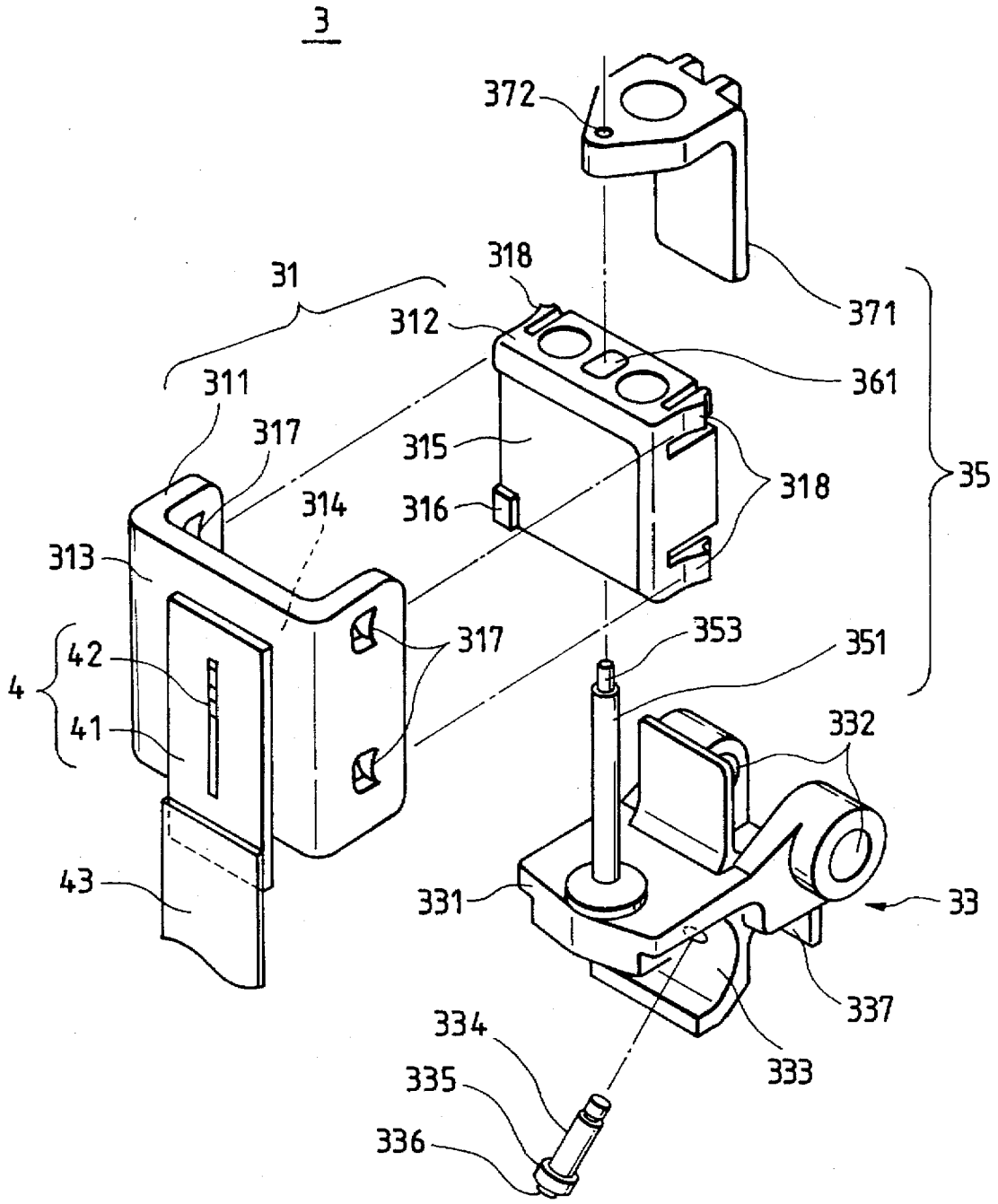
FIG. 3 is an exploded perspective view showing a head carriage mounted on the thermal printer shown in FIG. 1.
Figure 4A:
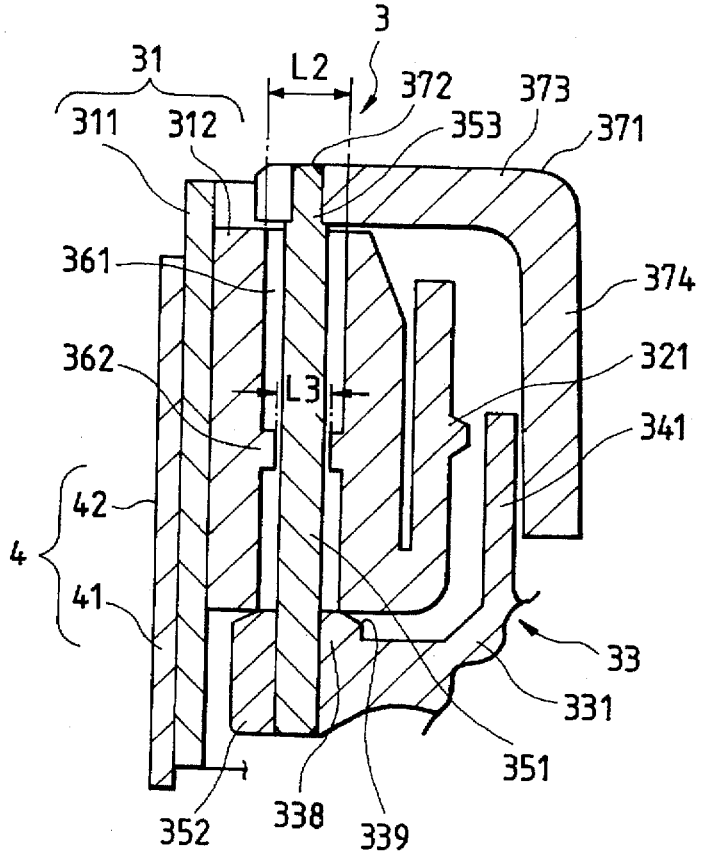
FIG. 4A is a longitudinal sectional view of the head carriage.

The construction of the head carriage 3 in this embodiment will be described next by referring mainly to FIGS. 3 and 4. The head carriage 3 of the this embodiment includes: a head support member 31 to which the thermal head 4 is attached; a holding member 33 for holding the head support member 31; and a connecting mechanism 35 for connecting both these members 31, 33 to each other. The head support member 31 essentially consists of a U-shaped head attachment plate 311 made of aluminum and a setting plate 312 made of plastic which is set into the rear of the head attachment plate 311. The front surface 313 of the head mounting plate 311 is arranged so as to be substantially parallel with the surface 21 of the platen 2. It is onto this surface 313 that the thermal head 4 is bonded. The thermal head 4 has an array 42 of heating elements formed on a surface of a ceramic substrate 41 thereof. The thermal head 4 is, e.g., a serial head having the array 42 consisting of a plurality of heating elements formed in a vertical direction (a paper forwarding direction). A flexible cable 43 on which a circuitry for driving the respective heating elements is formed is connected to the lower end of the ceramic substrate 41.

Between the rear surface 314 of the head attachment plate 311 and the front surface 315 of the setting plate 312 therein set is a slight gap. This slight gap is provided by a projection 316 formed at a corner of the front surface 315, and is utilized to lead the flexible cable 43 around. Further, the setting plate 312 is connected to the head attachment plate 311 by setting engagement projections 318 into grooves 317 corresponding to the engagement projections in position, the grooves 317 being formed on the side walls of the head attachment plate 311, and the engagement projections 318 being formed on the setting plate 312.

Then, the holding member 33 has a horizontally extending holding plate portion 331 for holding the head support member 31. On the rear surface of the holding plate portion are a pair of guide holes 332, through which the carriage guide shaft 7 slidably passes. Further, on the bottom of the holding plate portion is a groove 333 having a semicircular inner circumferential surface so as to cover almost a half of the outer circumference of the cylindrical cam shaft 6. The head portion 335 of a pin 334 is exposed to the inner circumferential surface of the groove 333. A cam projection 336 that is to be fitted into cam grooves 61 of the cylindrical cam shaft 6 is formed on the head portion 335. Still further, from the rear of the groove 333 projects a detection strip 337 perpendicularly downward. This detection strip 337 is detected by sensors that will be described later, and detection signals thereby obtained are used for drive-controlling the respective parts.

The connecting mechanism 35 for connecting the thus constructed head support member 31 and holding member 33 together will be described next. The connecting mechanism 35 includes: a rod like pin shaft 351 mounted on the holding member side; a pin shaft 351 insertion hole 361 formed on the head support member 31 side; and a pin shaft 351 release preventing member 371 for preventing the pin shaft 351 from being released from the insertion hole 361. The pin shaft 351 has the lower end 352 thereof firmly embedded into the horizontally extending holding plate portion 331 on the holding member 33 side. The pin shaft 351 extends perpendicularly. A circular projection 338 is formed on the outer circumference of the root of this pin shaft 351 by projecting the surface of the holding plate portion 331. The upper surface 339 of the projection is spherical.

Figure 4B:
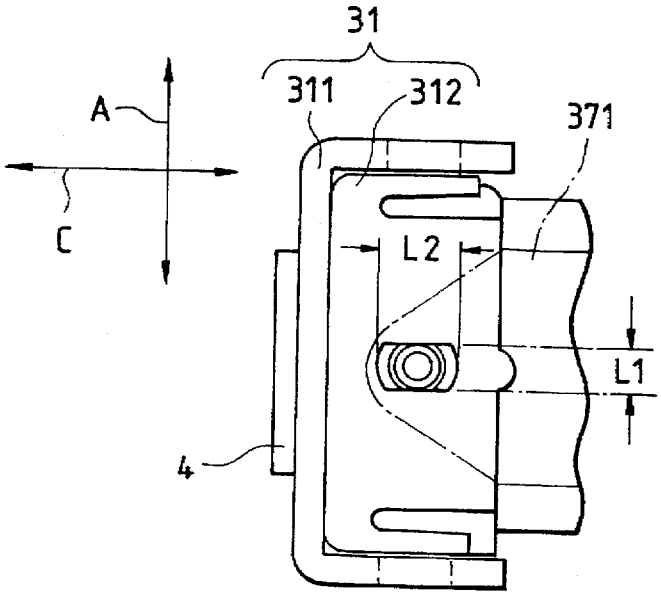
FIG. 4B is a partial top view partially showing the head carriage from top.

In contrast thereto, the insertion hole 361 is formed so as to vertically pass through the setting plate 312 in the middle of the head support member 31. The insertion hole 361 is designed to have the following section. As shown in FIG. 4B, a width of the insertion hole 361 in thermal head traveling directions (printing line directions) A is set to L1, which is a value substantially the same as the outer diameter of the pin shaft 351, whereas a width thereof in platen directions C orthogonal to these travelling directions is set to L2, which is a value larger than the outer diameter of the pin shaft 351 except for a central portion thereof. Further, as is understood from FIG. 4A, a bottleneck 362 whose width is set to L3, which is a value slightly larger than the outer diameter of the pin shaft, is formed by projecting both inner circumferential surface sides inward at a substantially central position along the axis of the insertion hole 361. Therefore, the pin shaft 351 inserted into the insertion hole 361 is rockable frontward and backward about the bottleneck 362.

Next, the upper end of the pin shaft 351 inserted into the insertion hole 361 projects from the upper end of the insertion hole 361. The projected portion 353 of the pin shaft 351 is fitted into a hole 372 formed in the pin shaft release preventing member 371. The pin shaft release preventing member 371 includes a horizontally extending plate portion 373 having the hole 372 formed therein, and a perpendicularly extending wall portion 374 that is bent from the rear end of the horizontally extending portion 373 perpendicularly downward.

It may be noted that a horizontally extending projection 321 is formed on the rear of the setting plate 312 on the head support plate side. On the side of the holding member 33, a perpendicularly extending regulating plate portion 341 is formed so as to confront this projection.

In the thus constructed head carriage 3 in this embodiment, the head support plate 31 to which the thermal head 4 is attached is supported on the spherical surface 339 on the side of the holding plate 33 so as to be rockable rightward and leftward about the pin shaft 351 mounted on the side of the holding plate 33. Further, the head support plate 31 is also rockable frontward and backward about the bottleneck 362 of the insertion hole 361. Thus, this embodiment is characterized as supporting the thermal head 4 by the head carriage 3 so as to be rockable frontward, backward, leftward, and rightward. Here, as is apparent from FIG. 4, the quantity of rocking in the left and right directions is regulated by the projection 321 formed on the rear side of the head support plate 31 being abutted against the front surface of the regulating plate portion 341 formed on the side of the holding plate 33. Further, the quantity of rock in the frontward and backward directions is regulated by the width L2 of the insertion hole 361, the axial length of the insertion hole, and the like.

(The structure of the platen)

Figure 5:
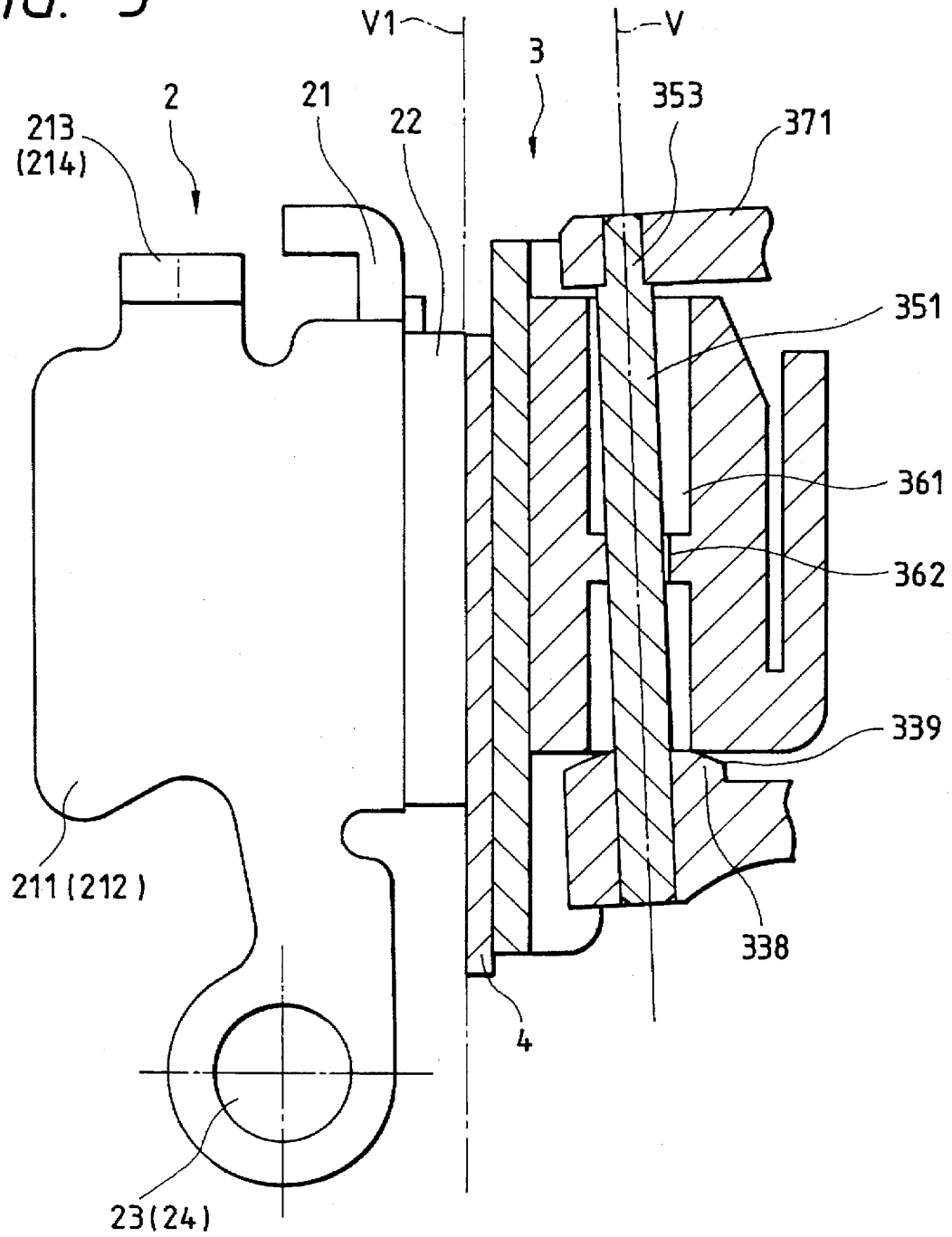
FIG. 5 is a diagram illustrative of a condition at the time of printing with a platen biased onto the head carriage.

The structure of the platen 2 will be described next with reference to FIGS. 1, 5, and 6. The platen 2 has a plate main body plate 21, and A rubber plate 22. The platen main body plate 21 is made of a flat metal plate, and the rubber plate 22 is bonded to the surface of the platen main body plate 21 so as to confront the thermal head. Both ends of the main bodyplate 21 are bent at right angles toward the rear side, so that side wall portions 211, 212 are formed. The lower ends of these side wall portions 211, 212 are connected to the printer frame 5 so as to be rotatable through rotating shafts 23, 24, respectively. Spring receiving portions 213, 215 are formed on the upper ends of the side wall portions 211, 212, respectively. Spring receiving portions 521, 522 are formed also on the upper ends of the side walls 52, 53 of the printer frame 5, respectively. These spring receiving portions 521, 522 are positioned a predetermined distance in front of the spring receiving portions 213, 214. Between the corresponding spring receiving portions 213, 521 as well as between the corresponding spring receiving portions 214, 522 are coil springs 25, 26 so as to be stretched, respectively. Therefore, in this embodiment, the platen 2 is rotatable about the rotating shafts 23, 24 at the lower ends thereof on both sides, and is usually, i.e., during printing, biased by the elastic tensile force of the coil springs 25, 26 onto the thermal head 4 that is supported by the head carriage 3 as shown in FIG. 5. The platen 2 can be evacuated from the thermal head 4 by resisting these spring forces.

FIG. 5 shows the platen 2 in the state of being biased onto the thermal head 4 by the spring forces (under printing), the thermal head 4 being attached to the head carriage 3. In this embodiment, the head carriage 3 is supported by the cylindrical cam shaft 6 and the guide shaft 7 so that the pin shaft 351 thereof extends perpendicularly with respect to the bottom wall 51 of the printer frame 5. That is, the axis of the pin shaft 351 in FIG. 5 coincides with a perpendicular line V. The surface of the rubber plate 22 of the platen 2 is biased onto the thermal head 4 by the spring forces, the thermal head 4 being attached to the head support plate 31 that is supported by the thus perpendicularly arranged pin shaft 351.

This embodiment is characterized as distancing the platen 2 from the thermal head 4 so that the platen 2 is in contact with the thermal head 4 with the surface of the rubber plate 22 slightly inclined toward the thermal head 4, i.e., with the surface of the rubber plate 22 not perpendicularly extending with respect to the thermal head 4. As a result of this arrangement, under the condition that the platen 2 is turned toward the thermal head 4 about the shafts 23, 24 at the lower ends thereof by the spring forces and biased onto the thermal head 4, a pressure contact surface V1 between the platen 2 and the thermal head 4 becomes slightly inclined with respect to the perpendicular line V. As a result, a force is applied to the head support plate 311 supported by the pin shaft 351 generally in a direction orthogonal to the pressure contact surface V1. That is, the force that is slightly inclined downward is applied to the head support plate 311.

This force contributes to holding and biasing the head support plate 311 onto the holding member 312 so as not to be allowed to have any play in the vertical directions. Hence, such trouble as impaired printing quality can be avoided. That is, when the head support plate 311 plays in the vertical directions during printing, the thermal head 4 attached thereto moves in the vertical directions, and this displaces the printing position of the thermal head and thus impairs the printing quality. Such trouble can be obviated by this force.

It may be noted that the biasing force can be applied to the head support plate 311 in the opposite direction, i.e., in the upward direction.

(Head carriage moving mechanism)

Figure 7:
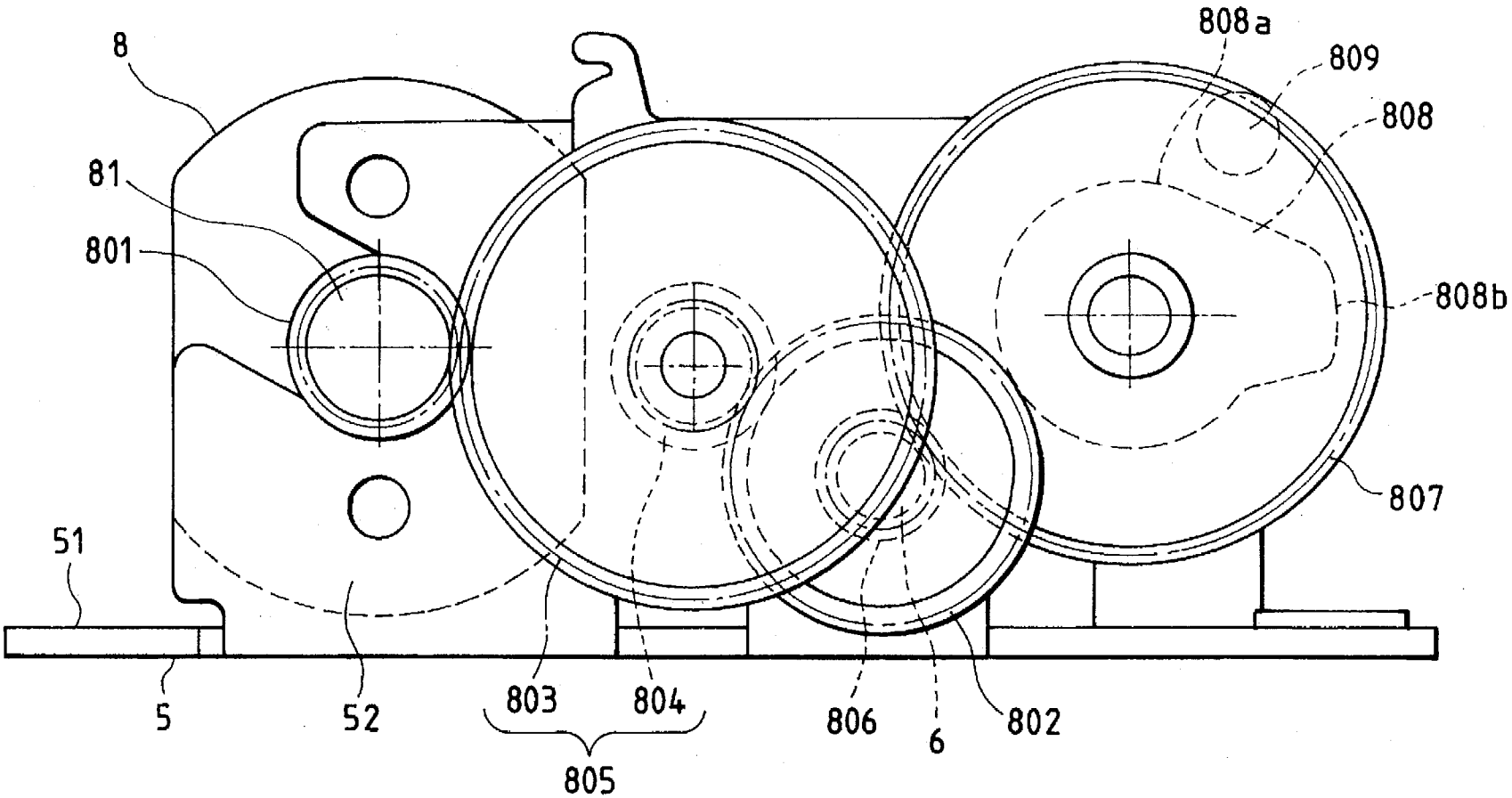
FIG. 7 is a diagram illustrative of a motive power transmitting mechanism, mounting on one side wall of the thermal head, for moving the head carriage and for rotating the platen.

A mechanism for reciprocating the head carriage 3 in the left and right directions (the printing directions) along the guide shaft 7 by the rotational force of the motor 8 will be described next with reference to FIGS. 1, 2, and 7. An output shaft 81 of the motor 8 projects sideways from the side wall 52 of the printer frame 5, and a drive gear 801 is secured thereto. On the other hand, the end of the cylindrical cam shaft 6 on the same side projects sideways from the side wall 52, and a driven gear 802 is secured thereto. The drive gear 801 and the driven gear 802 are connected to each other through a composite gear 805 constructed of a small gear 804 and a large gear 803 that are integrally formed so as to be concentric with each other. This composite gear 805 is also rotatably supported with respect to the side wall 52. It is through this composite gear 805 that the rotational force of the motor 8 is transmitted to the cylindrical cam shaft 6 while reduced to a predetermined reduction ratio.

The outer circumferential surface of the cylindrical cam shaft 6 has two oppositely faced spiral cam grooves 61, which are mutually connected at both ends thereof. The cam projection 336 formed on the head portion of the pin attached to the bottom of the holding member 33 of the head carriage 3 is fitted into these cam grooves 61 as described above. The head carriage 3 is further supported by the guide shaft 7 so as to be movable in the printing directions. Therefore, when the cylindrical cam shaft 6 is rotated, the head carriage 3 is guided by the guide shaft 7 through the rotation of the cam grooves 61 formed in the cylindrical camshaft 6 to move in the printing directions (to the left and right directions). Since the oppositely faced spiral cam grooves that meet at the ends of the cam groove shaft 6 are formed in this embodiment, the head carriage 3 reciprocates to the right and to the left continuously by rotating the motor 8 in a single direction.

(Platen rotating mechanism)

A small-diameter gear 806 is formed integrally with the inner side surface of the driven gear 802 that is secured to the end of the cylindrical cam shaft 6, the gear 806 and the gear 802 being concentric. The gear 806 rotates integrally with the gear 802. A large-diameter gear 807 is rotatably supported by the side wall 52 while meshed with this small-diameter gear 806. A cam plate 808 is formed integrally with the inner side surface of the gear 807. The cam plate 808 has a circular outer circumferential surface **808*a* with a predetermined radius, and a projecting surface 808*b*** formed by projecting a part of the outer circumferential surface outward in the radial direction over a predetermined range of angles.

Figure 6A:
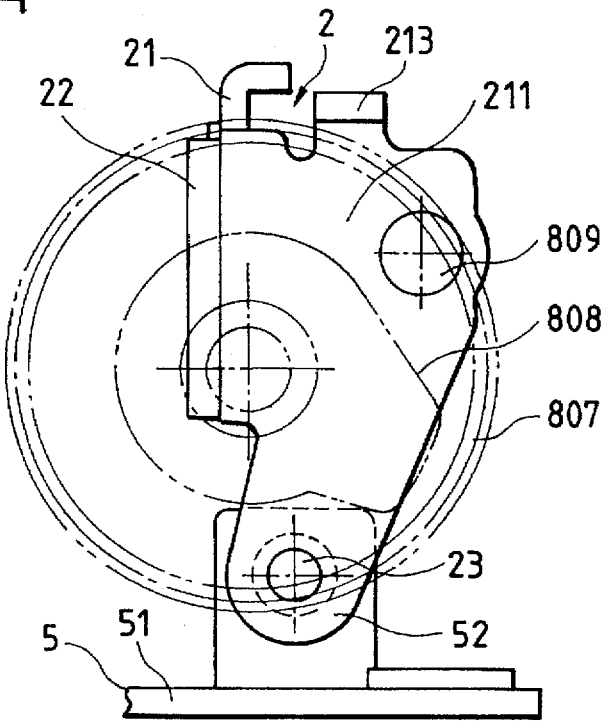
FIG. 6A shows a condition at the time of printing with the platen biased onto the head carriage.
Figure 6B:
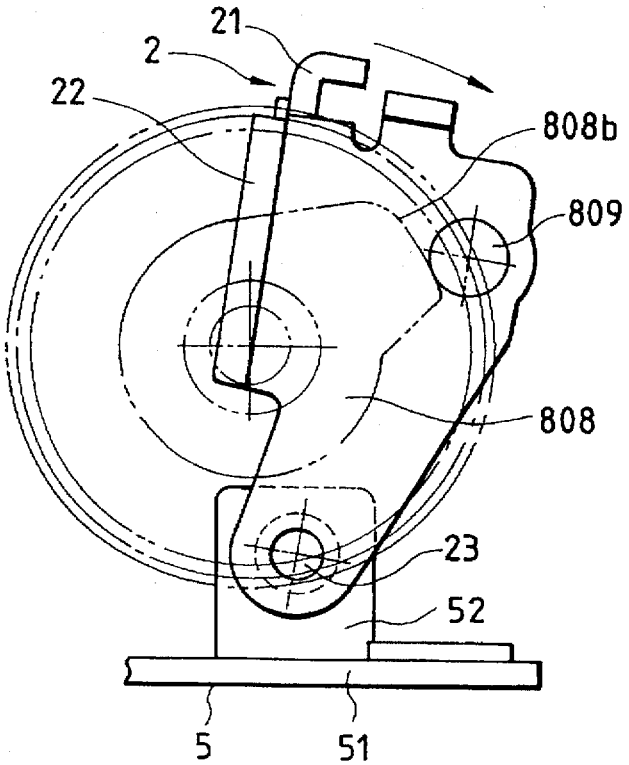
FIG. 6B shows a condition at the time of forwarding paper with the platen moving away from a thermal head.

On the other hand, the inner side of the cam plate 808 confronts an outer surface of the side wall portion 211 of the platen 2. The side wall portion 211 has a rod like projection 809 formed. The rod like projection 809 projects toward the cam plate 808 at a position outside the circular outer circumferential surface **808*a* in the radial direction. This projection 809 is arranged at a position engageable with the projecting surface 808***b* of the cam plate. Therefore, when the cam plate 808 rotates, the rod like projection 809 is biased outward in the radial direction by the projecting surface 808*b* over the predetermined range of angles every rotation. Here, the lower end of the side wall portion 211 of the platen having the projection 809 thereon formed can be turned about the shaft 23. Hence, the platen 2 is turned in the direction of moving away from the thermal head 4 by the cam plate 808 while resisting the spring forces biasing the platen 2 onto the thermal head 4. FIG. 6A shows a condition in which the platen 2 is biased onto the thermal head 4 (the printing condition); and FIG. 6B shows a condition in which the platen 2 is turned to an evacuated position by the camplate 808.

Here in this embodiment, not only the reduction ratio of the gear train from the motor 8 to the cam plate 808 is set to an appropriate value, but also the projecting surface 808*b* forming angular position and the like in the camplate are set to appropriate values, so that the platen 2 is turned backward by the cam plate 808 everytime the head carriage 3 has reached either one of the end positions of the cylindrical cam shaft 6 by the rotation of the cylindrical cam shaft 6.

(Paper forwarding mechanism)

Figure 8:
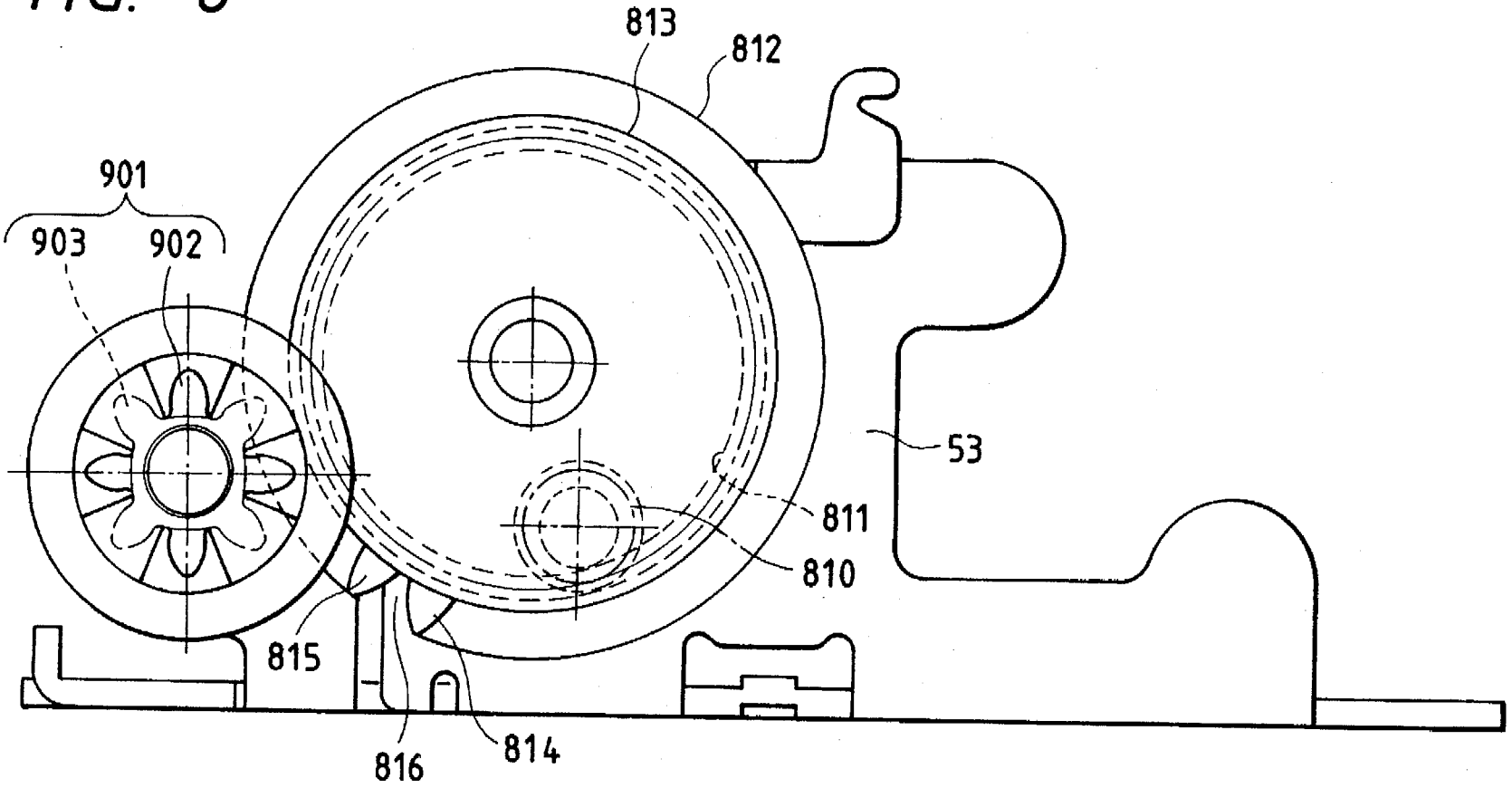
FIG. 8 is a diagram illustrative of a motive power transmitting mechanism, mounted on the other side wall of the thermal head, for forwarding the paper.

A mechanism for forwarding the paper a predetermined distance by rotating the paper feed roller 9 will be described next with reference to FIGS. 2, 8.

A small-diameter gear 810 is secured to the other end of the cylindrical cam shaft 6, i.e., the end portion projecting sideways from the other side wall 53 of the printer frame 5, and this gear 810 rotates integrally with the cylindrical cam shaft 6. An internal gear 811 is rotatably attached to the side wall 53 while meshing the small-diameter gear 810. The outer circumferential surface of the internal gear 811 is formed into a cam gear. That is, the cam gear has a large-diameter outer circumferential surface 812, and a small-diameter outer circumferential surface 813 which is formed so as to be concentric with the surface 812 on the outer surface side and whose diameter is smaller than the surface 812. The small-diameter outer circumferential surface 813 has two teeth 814, 815. A space 816 between these teeth extends toward the large-diameter outer circumferential surface 812.

On the other hand, a cam gear 901 is secured to the end of the shaft 91 of the paper feed roller 9 on the same side so as to be engageable with the thus constructed cam gear formed on the outer circumferential surface of the internal gear 811. The cam gear 901 is a composite gear composed of an inner side gear 902 and an outer side gear 903. As is understood from FIG. 8, each gear has four teeth pitched every 90°. The respective gears are integrated so as to be 45° out of phase with each other.

The cam gear that is formed on the outer circumferential surface of the internal gear 811 rotating integrally with the cylindrical cam shaft 6 meshes with the cam gear 901 of the paper feed roller shaft 91 once every rotation of the cylindrical cam shaft 6, so that the paper feed roller shaft 91 is rotated a predetermined quantity with the cam gear 901 meshed with the cam gear formed on the outer circumferential surface of the internal gear 811. As a result, the paper feed roller 9 mounted on the shaft 91 is rotated the same quantity to forward paper (not shown) corresponding to the quantity of rotation of the roller 9. The paper forwarding operation is performed with the head carriage 3 having reached either one of both ends in the moving directions thereof and with the platen 2 having been evacuated backward. To allow the paper forwarding operation to be performed in this way, the embodiment is designed to appropriately perform the operation of synchronizing the cam gear 901 for forwarding the paper with the camplate 808 for moving the platen, and a like operation.

(Detecting mechanism)

Figure 9:
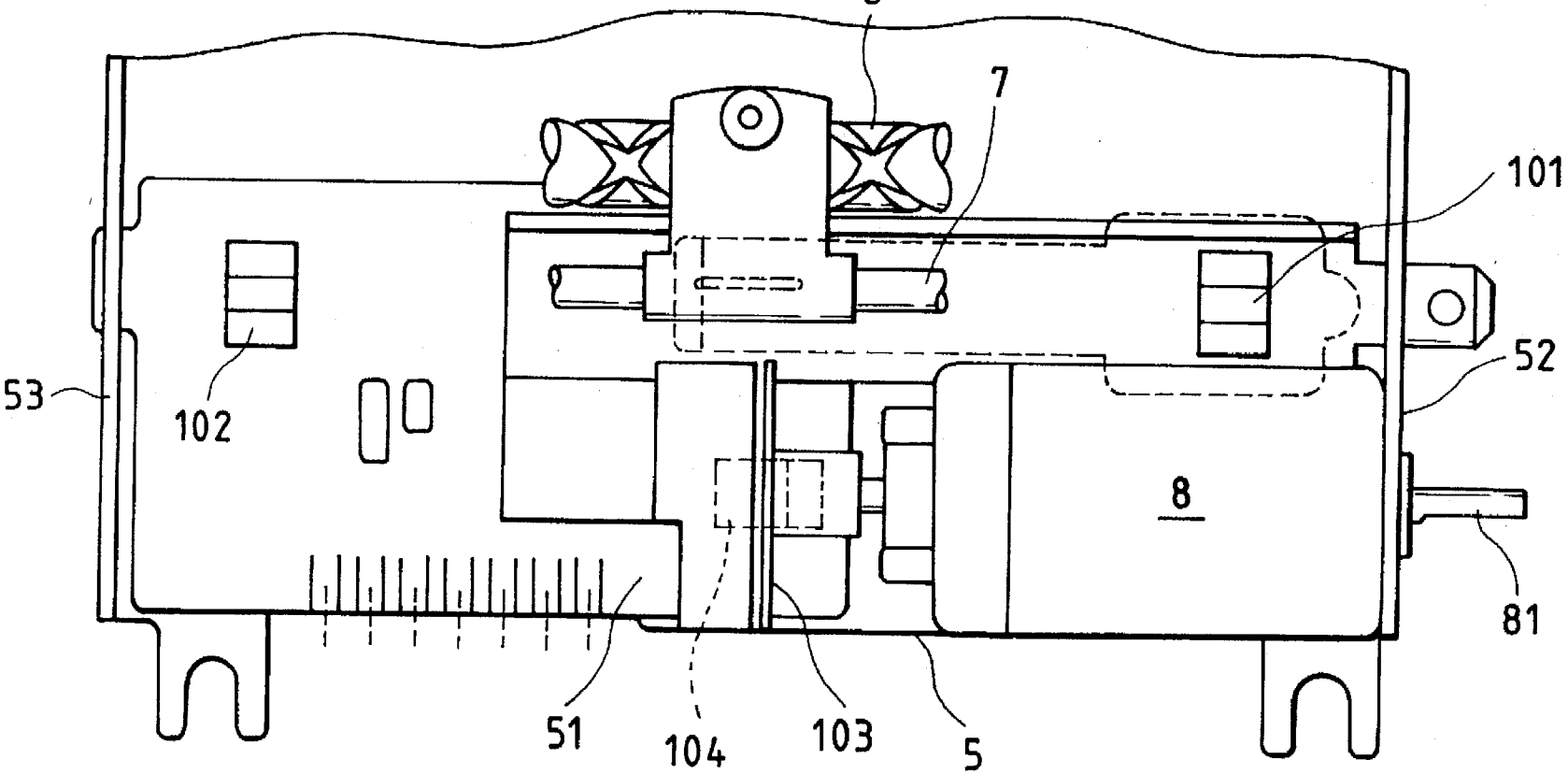
FIG. 9 is a partial plan view illustrative of where sensors are located in the thermal printer shown in FIG. 1.

It may be noted that optical sensors 101, 102 are provided at both end positions of the guide shaft 7 to detect both end positions of the head carriage 3 in this embodiment as shown in FIG. 9. Further, a slitted rotating plate 103 is attached to the projecting portion in the rear end of the motor output shaft 81. An optical sensor 104 for detecting the passage of the slits formed in the rotating plate 103 is arranged on the bottom wall 51 of the printer frame 5. In association with the rotation of the rotating plate 103 a slit detection signal is outputted from the sensor 104. Detection signals from the respective sensors are applied to a not shown drive control circuit. The drive control circuit controls respective heating elements formed on the thermal head 4 based on these signals to make a printing on the paper that is forwarded onto the platen. This is a drive control effected in ordinary thermal printers.

As described above, the thermal printer 1 presented as an embodiment of the invention is characterized as allowing the head carriage 3 supporting the thermal head 4 of the printer to be rockable in the leftward and rightward as well as frontward and backward directions by a single pin shaft 351 and a pin shaft insertion hole 361 having a bottleneck 362 formed therein. Further, the thermal printer 1 is also characterized as setting the width of the insertion hole 361 in the printing directions to a value substantially the same as the shaft member. Therefore, the thermal head is not likely to play in the printing directions but remains stable, which in turn contributes to implementing high printing quality. Hence, the invention, having a mechanism for making the head carriage 3 rockable in this way with an extremely simple construction, allows the head carriage 3 to be manufactured inexpensively with a simple construction. In addition, the head carriage 3 can be made compact, which in turn allows the printer to be made in small structure as a whole.

Still further, this embodiment is characterized as causing a force to be applied to the head support plate 31 in a direction that is inclined with respect to a direction orthogonal to the pin shaft 351 on the side of the head carriage 3 with the head carriage 3 biased by the platen 2, the head support plate 31 being held by the pin shaft. Therefore, the application of this force prevents the head support plate 31 having the thermal head carried thereon from playing vertically. Hence, such trouble as impaired printing quality due to the thermal head moving vertically and the printing position of the thermal head being thereby displaced can be prevented.

Further, this embodiment is characterized as limiting the quantity of turning of the head support plate 31 about the pin shaft 351 by the projection 321 formed in the rear of the head support plate 31 and the regulating plate portion 341 formed on the side of the holding member 33. Therefore, the following trouble, e.g., can be avoided: an end of the head support plate 31 is abutted against the paper being forwarded along the platen 2 due to the head support plate 31 being turned to a large extent under the condition that the head carriage 3 has reached either one of both ends and the platen 2 has therefore been evacuated.

On the other hand, this embodiment is also characterized as moving the platen 2 away from the thermal head 4 by turning the platen 2 during printing, i.e., when the head carriage 3 has reached either one of both end positions. The mechanism for turning the platen 2 can be constructed not only easily but also compactly compared with the mechanism for evacuating from the platen 2 the thermal head 4 that is in movement while mounted on the head carriage 3. Therefore, the whole construction of the printer according to this embodiment can be constructed compactly as much as the mechanism is constructed compactly.

Further, this embodiment is characterized as supplying the force for driving the platen turning mechanism for evacuating the plate 2 from the thermal head 4 from the motor 8 for moving the head carriage 3. Likewise, the force for driving the paper forwarding mechanism is supplied from the motor 8. In this way, the embodiment is designed to transmit the rotating force of the motor 8, which is the only one driving source, to the respective driving parts through the motive power transmitting mechanism consisting of the gear trains. Therefore, this embodiment is advantageous in reducing the number of parts and components compared with the case where the driving sources separately dedicated to the respective driven parts are arranged. Further, this embodiment is also advantageous in constructing the control system in a simple way and driving the driven parts properly at all times compared with the case where the driving sources separately dedicated to the respective driven parts are driven by synchronizing the driving sources with an electric control circuit since the driven parts in this embodiment are mechanically synchronized by the mechanical motive power transmitting mechanism as well as by the cam mechanism mounted in the mechanical motive power transmitting mechanism and the like.

Second embodiment will be described with reference to FIGS. 10 to 12.

According to the second embodiment, an energizing member is arranged to energize the thermal head upwardly or downwardly so that the thermal head is always positioned at upper position or lower position. Specifically, the second embodiment shows a case of that a spring member is arranged to energize the head supporting member downwardly from the upper position.

Figure 10:
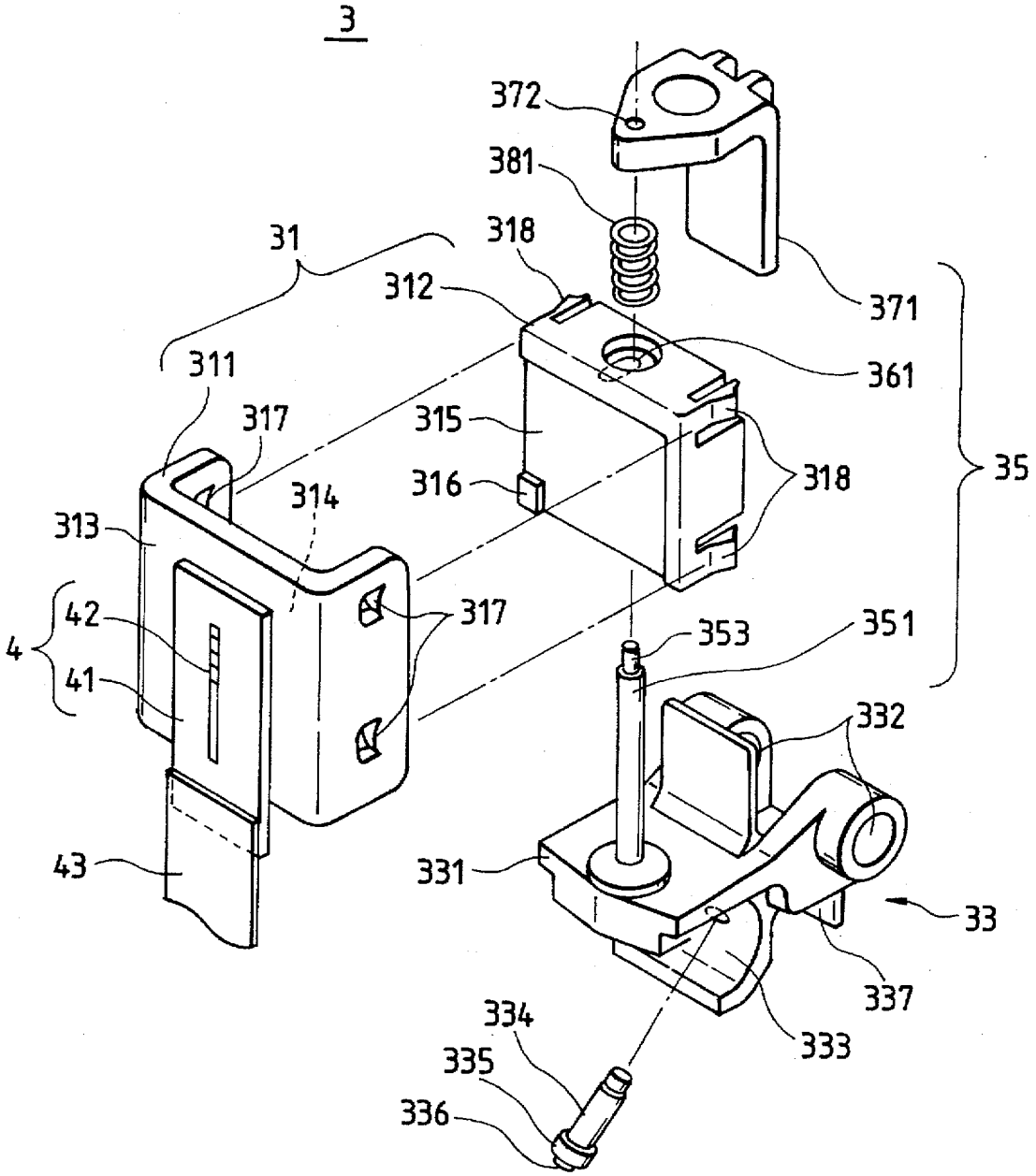
FIG. 10 is an exploded perspective view showing a head carriage mounted on the thermal printer of the second embodiment of the present invention.
Figure 11A:
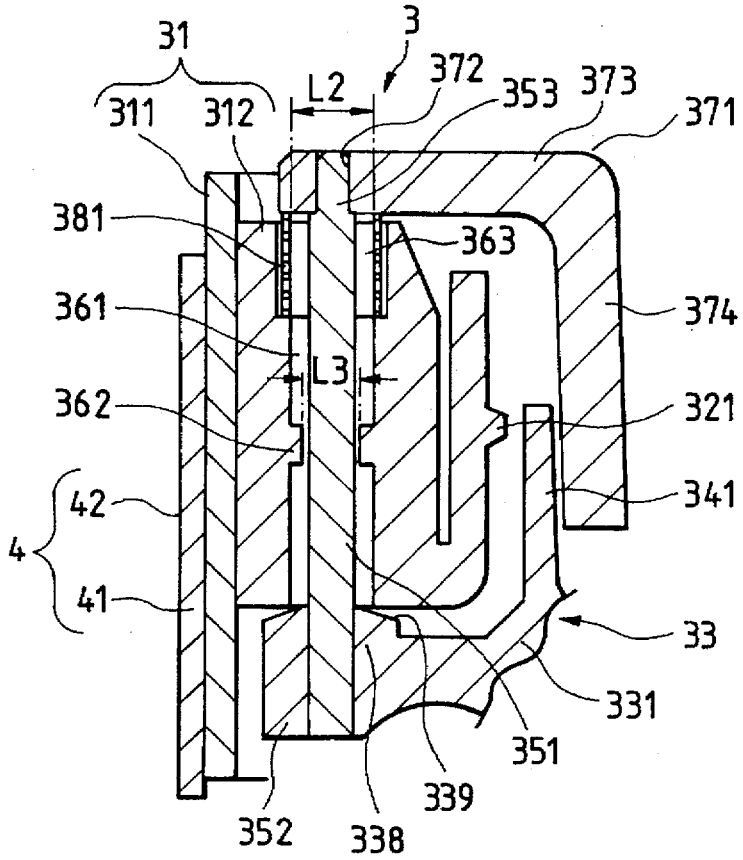
FIG. 11A is a longitudinal sectional view of the head carriage.
Figure 11B:
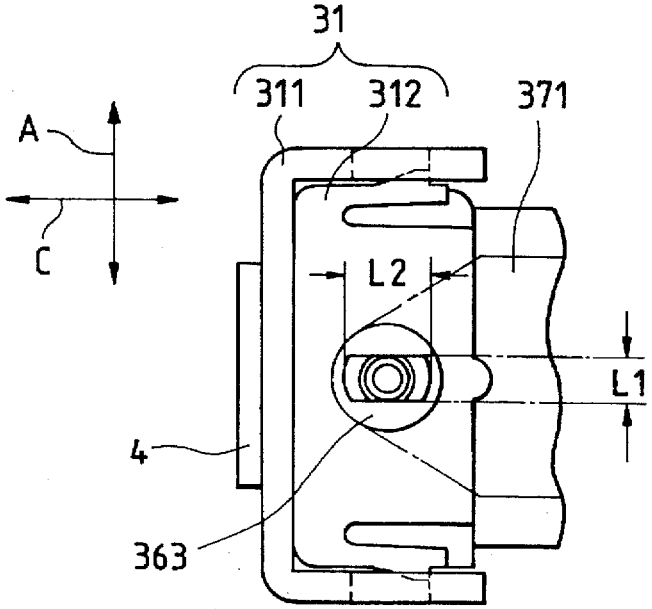
FIG. 11B is a partial top view partially showing the head carriage from top.
Figure 12:
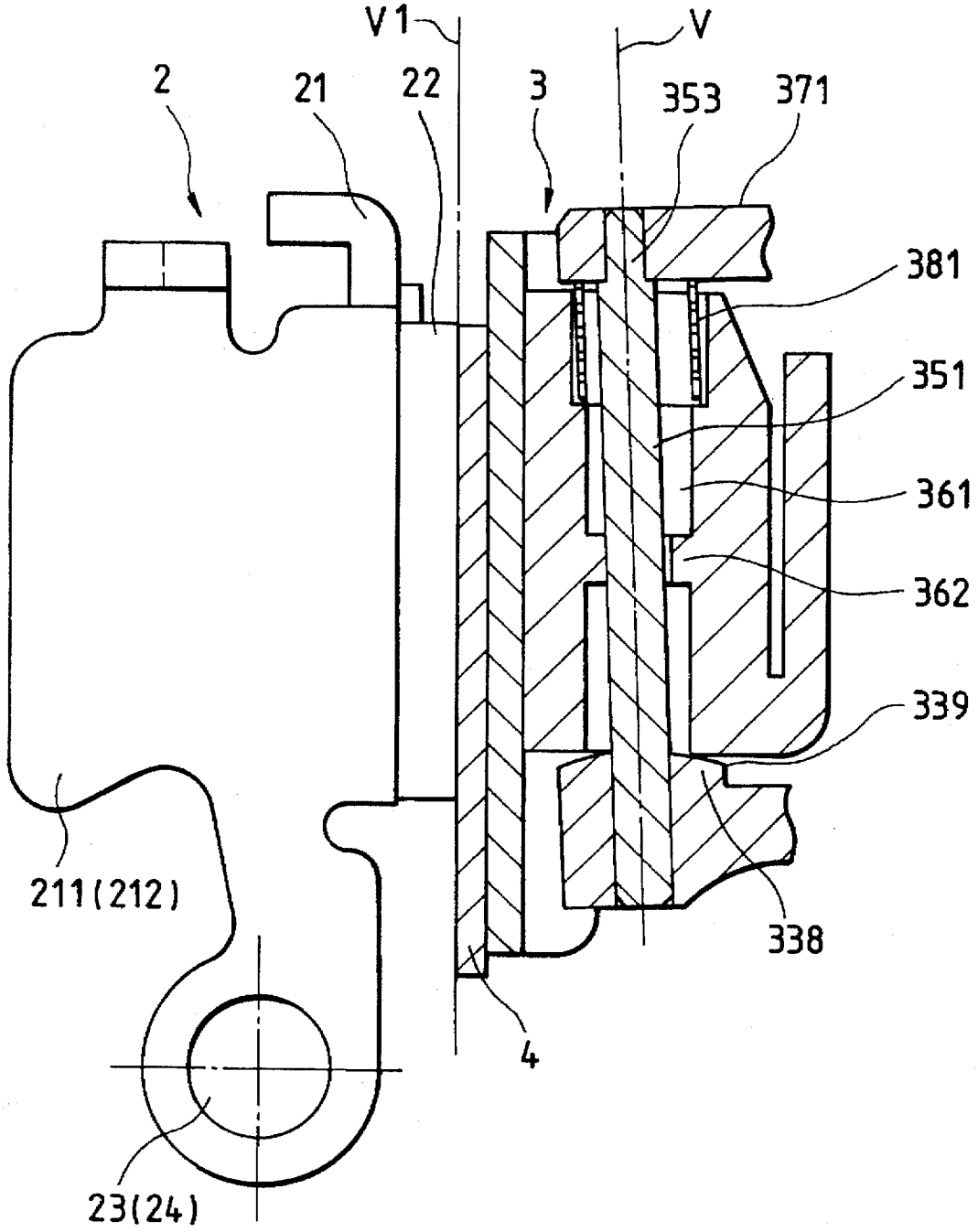
FIG. 12 is a diagram illustrative of a condition at the time of printing with a platen biased onto the head carriage of the second embodiment.

In FIGS. 10 to 12, same reference numerals are assigned to same or equivalent parts of the first embodiment.

A compression spring 281 is disposed between the head supporting member 31 and the pin shaft release preventing member 371 so as to energize the head supporting member 31 downwardly. The spring attaching part 363 is disposed upper position of the insertion hole 361 of the head supporting member 31. The spring attaching part 363 and the compression spring 361 are designed so that the spring attaching part 363 is larger than the dimension of the width L2 of the insertion hole 361 and an inner diameter of the compression spring 381 to be attached is lager than the outer diameter of the insertion hole 361. Accordingly, the movable amount of the thermal head 4 in the direction of forward and backward is restricted by the dimension of the width L2 and the length of the insertion hole 361 regardless the compression spring 361. The projection portion 353 and the diameter of the hole 372 are determined to prevent the pin shaft release preventing member 371 from coming out.

According to this structure, as same with the first embodiment, the downward force is affected to the head supporting member in such manner that the platen 2 is brought into contact with the thermal head 4. Furthermore, the head supporting member is more energized by the force of the compression spring 381.

As a result, the play of the head supporting plate 31 to which the thermal head is mounted is prevented in the vatical direction. Therefore, such trouble as impaired printing quality due to the thermal head moving vertically and the printing position of the thermal head being thereby displaced can be prevented. The compression spring 381 enhances such effect of the invention.

When the platen 2 is not pressed to the thermal head, the head supporting plate 31 is also energized downwardly. Accordingly, even if the platen 2 is pressed to the thermal head 4, at that time the head supporting plate 31 is not displaced. Therefore, the printing can be immediately started.

It is described other examples to energizing the head supporting plate 31 in an axial direction of the pin shaft 351.

As a third embodiment, a leaf spring may be used as the compression spring 381. In this case, the leaf spring is disposed between the head supporting plate 31 and the pin shaft release preventing member 371 to energize the head supporting plate 31 downwardly. The leaf spring may be made of metal, plastic or the like. If a plastic leaf spring is employed and the pin shaft release preventing member 371 and head supporting plate 31 are made of plastic, such parts can be integrally formed as a single part. Accordingly, the number of parts can be decreased.

As a forth embodiment, the head supporting plate 31 may be pulled from the supporting member by a pulling spring. In this case, the head supporting plate is stably energized and the pin shaft release preventing member 371 can be omitted. Accordingly, the number of parts can be decreased.

Furthermore, an inclination of the press contacting surface V1 may be opposed with respect to the perpendicular line V in FIGS. 5 and 12 so as to cause a upward force. In this case, the compression spring is arranged to cause a upward force affected to the pin shaft 351.

As described in the foregoing, the thermal printer of the invention is characterized as constructing a mechanism for holding the thermal head so as to be rockable upward and downward as well as leftward and rightward, by a single shaft member and an insertion hole for inserting the shaft member, the insertion hole having a bottleneck. Therefore, as a result of this construction of the invention, the function similar to that of the support mechanisms based on the elastic member, on the pivot shaft, or on the gimbal mechanism can be implemented with far simpler structure than that of the latter support mechanisms. In addition, such a simple structure allows the head carriage and hence the printer to be made compact as well as inexpensive as much as the thermal head holding mechanism is simple.

Further, the invention is also characterized as causing the force for biasing the head support member to be applied to the head support member in a direction that is inclined with respect to a direction orthogonal to the shaft member with the platen being biased onto the head support member so that the head support member having the thermal head mounted thereon is free from playing vertically with respect to the shaft member. As a result of this construction, the vertically playing of the thermal head at the time of printing can be suppressed reliably, which in turn contributes to further improving the printing quality.

Furthermore, even if a play of the thermal head is caused in a vertical direction, the thermal head is always positioned at upper or lower position. Therefore, the displacement of the printing position is restricted so that impair of the printing quality is prevented.

Still further, if a mechanism for regulating the quantity of turning of the head support member about the pin shaft is provided, the following trouble, e.g., can be avoided reliably: the head support member is turned too largely to cause the end of the head support member to be abutted against the paper being forwarded onto the platen under the condition that the platen is evacuated. Therefore, it is preferred that such a mechanism be provided.

What is claimed is:

1. A thermal printer comprising: a thermal head having heating elements formed thereon; a head carriage carrying the thermal head; a first moving mechanism for moving the head carriage in a printing direction; and a printing paper forwarding mechanism; the thermal head being brought in contact with the printing paper forwarded on the platen by the printing paper forwarding mechanism; wherein the head carriage includes: a head support member to which the thermal head is attached; a holding member for holding the head support member; and a connecting mechanism for connecting the head support member to the holding member so as to be rockable in forward and backward as well as leftward and rightward directions;

the connecting mechanism includes: a shaft member fixed to the holding member; and an insertion hole for allowing the shaft member to be inserted thereinto, the insertion hole being formed in the head support member;

a width of the insertion hole in the printing direction is substantially the same as a width of the shaft member;

a width of the insertion hole in a direction of the platen, the direction being orthogonal to the printing direction, is larger than the width of the shaft member as a whole but narrowed at an intermediate position in an axial direction thereof; and the head support member is rotatable in the direction of the platen.

2. A thermal printer according to claim 1, further comprising a second moving mechanism for moving at least one of the platen and the head relative to each other so that the head comes in pressure contact with the platen when printing, and the head moves away from the platen when forwarding the printing paper, wherein a pressure contact surface of the thermal head is arranged with respect to the shaft member with a predetermined inclination with the thermal head being in pressure contact with the platen by the second moving mechanism.

3. A thermal printer according to claim 2, wherein the pressure contact surface of the thermal head is arranged with respect to the shaft member with such an inclination as to cause the thermal head and the shaft member to be spaced further apart in a downward direction, when the thermal head is in pressure contact with the platen.

4. A thermal printer according to claim 1, wherein said connecting mechanism includes a spring member for energizing said head support member in an axial direction of said shaft member.

5. A thermal printer according to claim 1, wherein the connecting mechanism has a regulating member for regulating a quantity of rock of the head support member about an axis of the shaft member, the regulating member being located either in the head support member or in the holding member.

6. A thermal printer according to claim 2, wherein the second moving mechanism is a platen moving mechanism for moving the platen with respect to the thermal head carried on the head carriage.

7. A thermal printer according to claim 6, wherein the thermal head is driven so that a reciprocating printing can be made; and the platen moving mechanism is designed to evacuate the platen from the thermal head when the head carriage has reached one of both end positions in a direction of movement thereof.

8. In a thermal printer having a thermal head having heating elements formed thereon, a head carriage carrying the thermal head, a first moving mechanism for moving the head carriage in a printing direction, and a printing paper forwarding mechanism, and being designed to print data by causing the thermal head to come in contact with a printing paper forwarded on a platen by the printing paper forwarding mechanism, the improvement wherein:

the head carriage includes: a head support member to which the thermal head is attached; a holding member for holding the head support member; and a connecting mechanism for connecting the head support member to the holding member so as to be rockable in forward and backward as well as leftward and rightward directions;

the connecting mechanism includes: a shaft member fixed to the holding member; and an insertion hole for allowing the shaft member to be inserted thereinto, the insertion hole being formed in the head support member;

a width of the insertion hole in the printing direction is substantially the same as a width of the shaft member;

a width of the insertion hole in a direction of the platen, the direction being orthogonal to the printing direction, is larger than the width of the shaft member as a whole but narrowed at an intermediate position in an axial direction thereof; and the head support member is rotatable in the direction of the platen.

9. A thermal printer comprising:

a platen for supporting a printing paper, the platen having a contacting plane surface which has a rectangular shape;

a head carriage which is movable along a longitudinal direction of the contacting plane surface of the platen;

a thermal head having a plurality of heating elements provided on a surface which is brought into contact with the printing paper supported on the platen, said heating elements being arranged in a direction perpendicular to a movable direction of the head carriage; and means for supporting the thermal head, said means for supporting the thermal head being rockably supported in a direction of the longitudinal direction of the contacting plane surface and a direction perpendicular thereto, and being inhibited from moving in the movable direction of the head carriage.

* * * * *